US007673702B2

(12) United States Patent
Johnson et al.

(10) Patent No.: US 7,673,702 B2
(45) Date of Patent: Mar. 9, 2010

(54) IMPACT WRENCH

(75) Inventors: Joshua Odell Johnson, Hellertown, PA (US); Ryan Scott Amend, Dayton, NJ (US); Warren Andrew Seith, Bethlehem, PA (US)

(73) Assignee: Ingersoll-Rand Company, Montvale, NJ (US)

( * ) Notice: Subject to any disclaimer, the term of this patent is extended or adjusted under 35 U.S.C. 154(b) by 97 days.

(21) Appl. No.: 11/836,279

(22) Filed: Aug. 9, 2007

(65) Prior Publication Data

US 2009/0038816 A1 Feb. 12, 2009

(51) Int. Cl.
*B25B 19/00* (2006.01)
*B25D 15/00* (2006.01)

(52) U.S. Cl. ..... 173/93; 173/93.6; 173/109; 173/178

(58) Field of Classification Search ..... 173/93, 173/93.5, 178, 211, 114, 216, 203, 205, 109, 173/93.6
See application file for complete search history.

(56) References Cited

U.S. PATENT DOCUMENTS 2,160,150 A * 5/1939 Jimerson et al. ..... 173/93.6
2,712,254 A * 7/1955 Schodeberg ..... 173/93.6
3,001,428 A * 9/1961 Sindelar ..... 173/93.6
3,174,597 A * 3/1965 Schaedler et al. ..... 173/93.6
3,174,606 A * 3/1965 Hornschuch et al. ..... 192/150
3,198,303 A * 8/1965 Brown ..... 173/93.6
3,414,066 A * 12/1968 Wallace ..... 173/93.6
4,277,074 A * 7/1981 Kilberis ..... 279/60
4,811,797 A * 3/1989 Antipov et al. ..... 173/93.6
5,601,149 A * 2/1997 Kawasaki et al. ..... 173/93.5
5,836,403 A * 11/1998 Putney et al. ..... 173/205
5,873,786 A * 2/1999 Hosoya et al. ..... 464/73
5,992,538 A * 11/1999 Marcengill et al. ..... 173/93
6,158,526 A * 12/2000 Ghode et al. ..... 173/93
6,457,535 B1 * 10/2002 Tanaka ..... 173/48
6,733,414 B2 * 5/2004 Elger ..... 475/331
7,048,075 B2 * 5/2006 Saito et al. ..... 173/93.5

* cited by examiner

*Primary Examiner*—Scott A. Smith
(74) *Attorney, Agent, or Firm*—Michael Best & Friedrich LLP

(57) ABSTRACT

An impact mechanism includes a shaft, a hammer and an anvil coupled to the hammer. The shaft has a first helical groove and the hammer has a second helical groove. A ball is received in the first and second helical grooves to rotationally couple the hammer to the shaft and permit axial travel of the hammer relative to the shaft. An axial stop inhibits axial travel of the hammer along a first travel path and permits axial travel of the hammer along a second travel path. The axial stop includes first and second stop members, the first and second stop members having a first relative position to inhibit axial travel of the hammer and a second relative position to permit axial travel of the hammer.

20 Claims, 6 Drawing Sheets

IMPACT WRENCH

FIELD OF THE INVENTION

The present invention relates to impact wrenches.

BACKGROUND

An impact wrench is a tool that is used to install and remove threaded fasteners. The tool includes a motor coupled to an impact mechanism that converts the torque of the motor into a series of powerful rotary blows directed to an output shaft called an anvil.

SUMMARY

In one embodiment, the invention provides an impact tool including a motor and a shaft driven for rotation about an axis by the motor, a hammer and an anvil coupled to the hammer. The shaft has a first helical groove and the hammer has a second helical groove. A ball is received in the first and second helical grooves and rotationally couples the hammer to the shaft and permits axial travel of the hammer relative to the shaft. The impact tool also includes an axial stop for inhibiting axial travel of the hammer. The hammer is capable of moving along a first travel path and a second travel path different from the first travel path. The axial stop permits axial travel of the hammer on the first travel path and inhibits axial travel of the hammer on the second travel path. The axial stop includes first and second stop members, the first and second stop members having a first relative position to inhibit axial travel of the hammer and a second relative position to permit axial travel of the hammer.

In another embodiment the invention provides a method of operating an impact tool of the type having a ball-and-cam impact mechanism. The method includes driving a cam shaft for rotation about an axis, driving a hammer for rotation about the axis with the cam shaft and driving an anvil for rotation about the axis with the hammer. The method also includes disengaging the hammer from the anvil by moving the hammer against a bias along the axis away from the anvil and releasing the hammer to re-engage the anvil so as to deliver an impact blow to the anvil. The method includes permitting the hammer to move along a first travel path, the first travel path including rotation about the axis, and inhibiting the hammer from moving along a second travel path, the second travel path being substantially non-rotational.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
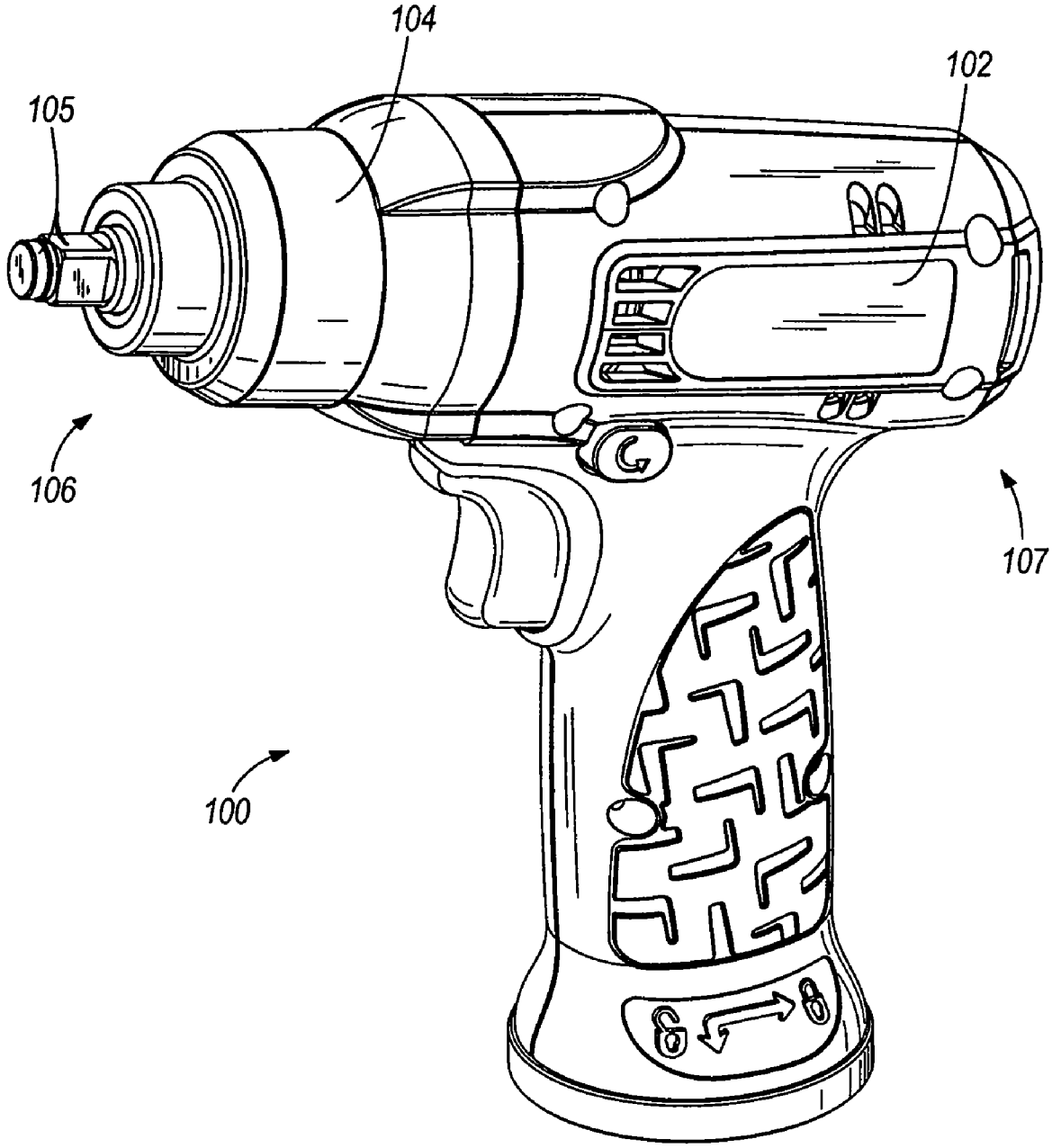
FIG. 1 is a perspective view of an impact tool according to an embodiment of the invention.
Figure 2:
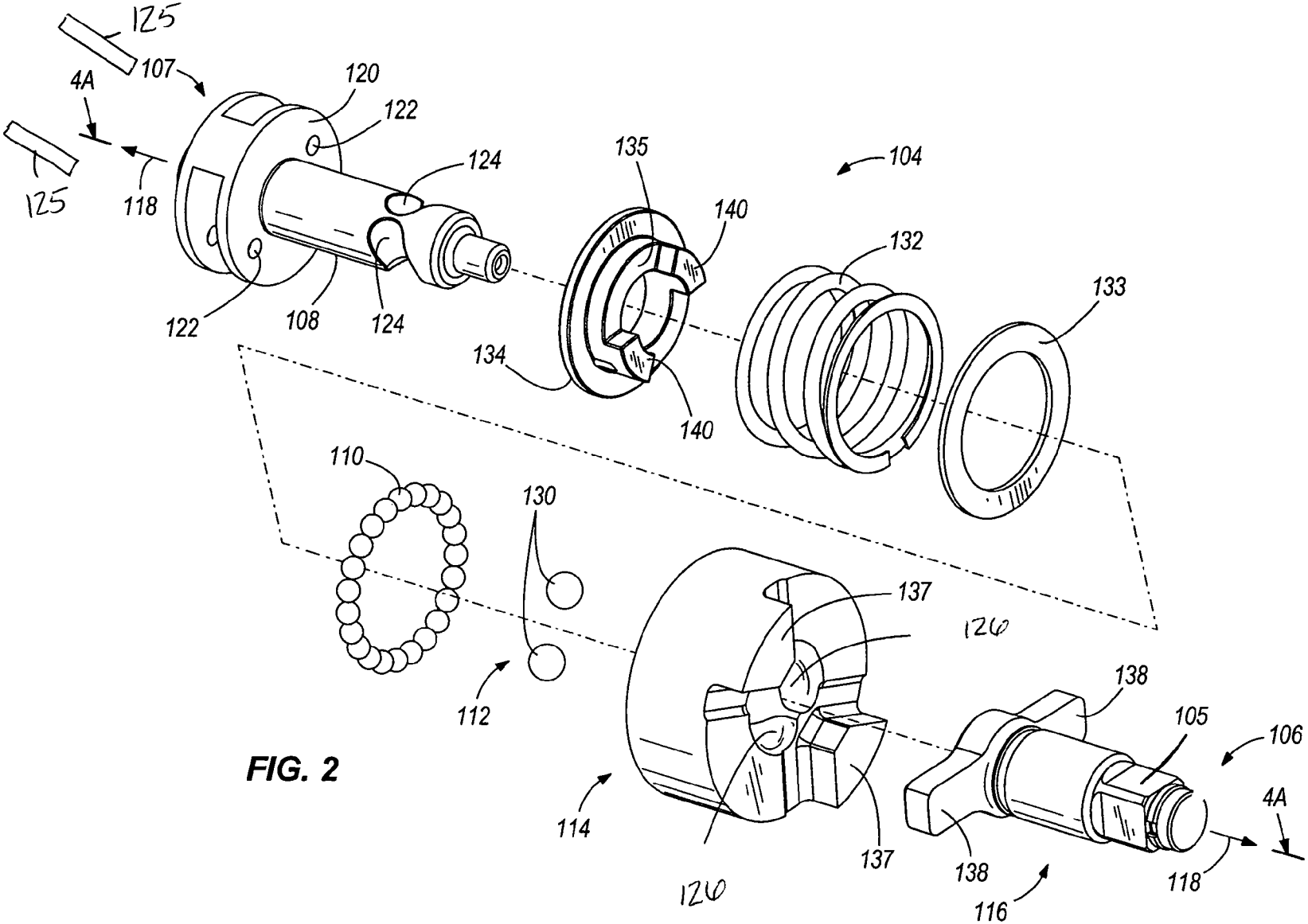
FIG. 2 is an exploded perspective view of the impact mechanism of FIG. 1.
Figure 3:
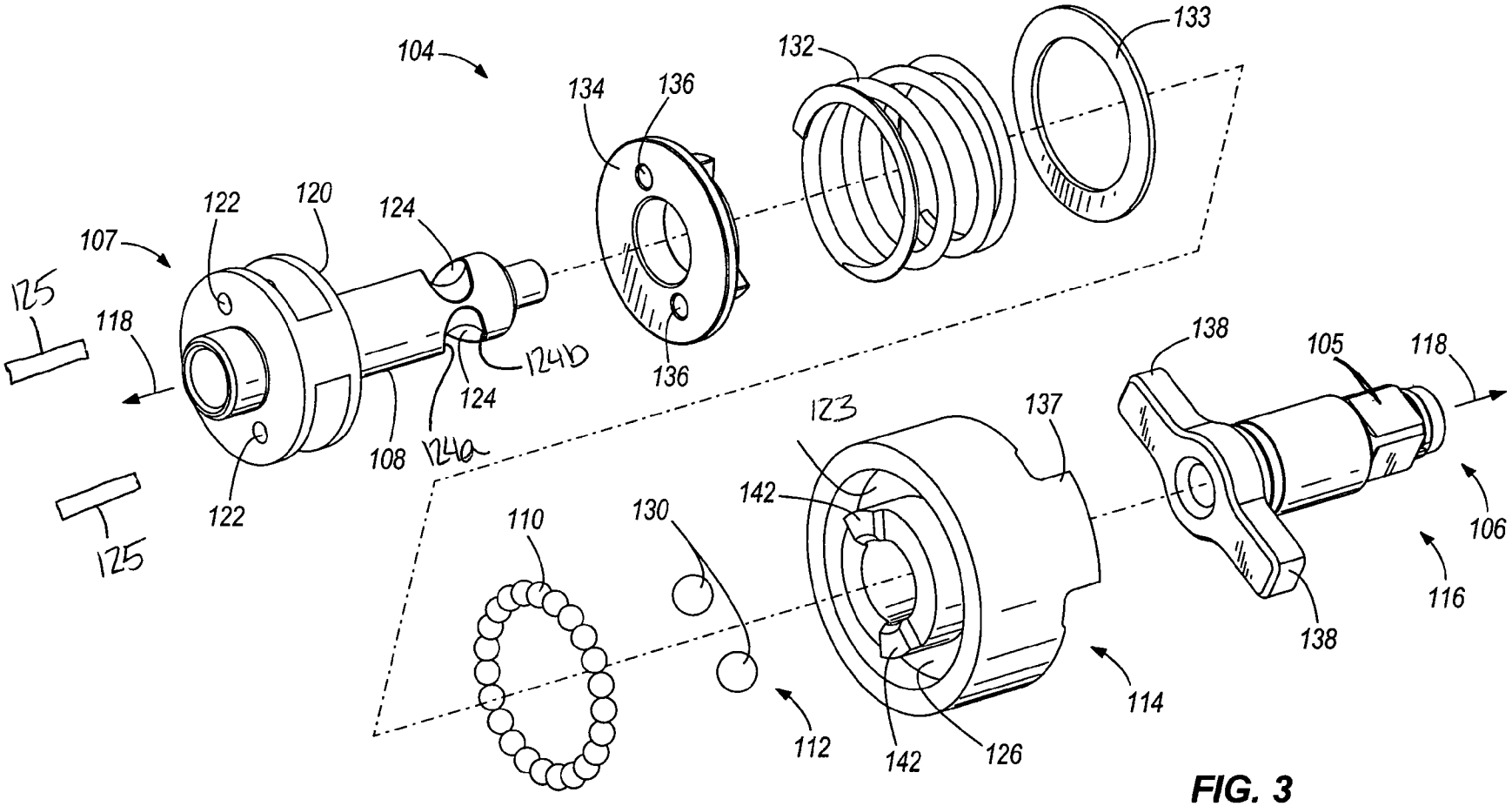
FIG. 3 is another exploded perspective view of the impact mechanism of FIG. 1.

FIG. 1 illustrates an impact tool 100 according to an embodiment of the invention. The impact tool 100 includes a motor 102, an impact mechanism 104 driven by the motor 102, and an output spindle 105 driven for rotation by the impact mechanism 104. The impact tool 100 has a forward or output end 106 and a rear or input end 107. The impact tool 100 can be an impact wrench.

FIGS. 2-4B illustrate the impact mechanism 104 according to an embodiment of the invention. The impact mechanism 104 is of the type commonly known as a ball-and-cam impact mechanism. U.S. Pat. No. 2,160,150 to Jimerson et al. describes a ball-and-cam impact mechanism, the entire disclosure of which is hereby incorporated herein by reference.

The impact mechanism 104 includes a cam shaft 108, a bearing 110, an impact bearing 112, a hammer 114 and an anvil 116. The cam shaft 108 is driven for rotation about a longitudinal axis 118 by the motor 102. The cam shaft 108 includes a planetary gear carrier 120 for coupling to the motor 102. Gear pin holes 122 extend through the planetary gear carrier 120 and receive pins 125 for coupling to the motor 102. The cam shaft 108 is coupled to the hammer 114 through the impact bearing 112. The hammer 114 includes an annular recess 123 for receiving the bearing 110. The hammer 114 is rotatable over the bearing 110 and in turn drives rotation of the anvil 116 about the longitudinal axis 118. The anvil 116 is integrally formed with the output spindle 105.

The cam shaft 108 and the hammer 114 each include a pair of opposed helical grooves 124 and 126, respectively. The hammer grooves 126 have open ends facing the anvil 116 for ease of machining and assembly. Thus, the cam shaft groove 124 is partially defined by a forward facing wall 124*a* and a rearward facing wall 124*b*, while the hammer groove 126 is partially defined by a forward facing wall 126*a* and lacks a rearward facing wall. A pair of balls 130 forming the impact bearing 112 couple the cam shaft 108 to the hammer 114. Each ball 130 is received in a race formed by the hammer groove 126 and the corresponding cam shaft groove 124.

A spring member 132 and a washer 133 are disposed in between the planetary gear carrier 120 and the hammer 114 to bias the hammer 114 away from the planetary gear carrier 120. The washer 133 and an end portion of the spring member 132 are received within the hammer annular recess 123 and abut the bearing 110.

A spring retainer 134 is located in between the planetary gear carrier 120 and the spring member 132 and includes an annular flange 135 for aligning the spring member 132. The spring retainer 134 includes blind holes 136 for receiving the pins 125 extending through the planetary groove carrier 120 and for aligning the spring retainer 134 to the planetary gear carrier 120. The cam shaft grooves 124 (see below) in turn are formed in the cam shaft 108 in alignment with the planetary gear carrier 120 so that the spring retainer 134 is aligned to the cam shaft grooves 124.

A forward-facing end of the hammer 114 includes a pair of lugs or ears 137 for driving rotation of the anvil 116. The anvil 116 likewise includes a pair of lugs or ears 138 for cooperating with the hammer lugs 137.

To assemble the impact mechanism 104, the spring retainer 134, the spring member 132 and the washer 133 are inserted over the cam shaft 108. The bearing 110 is placed within the annular recess 123 and the hammer 114 is inserted over the cam shaft 108 to receive the washer 133 and the end portion of the spring member 132 within the annular recess 123. Next, the hammer 114 is moved towards the spring retainer 134 against the force of the spring member 132. As the hammer 114 moves axially towards the spring retainer 134, there is a clearance between the cam shaft 108 and the hammer 114 at the hammer grooves 126 so that the cam shaft groove 124 is exposed. This clearance is provided by the open end of the hammer grooves 126, and is slightly greater than a diameter of the balls 130. One ball 130 is inserted into each of the cam shaft 108 grooves 124 and the hammer 114 is released. The biasing force of the spring member 132 forces the hammer 114 away from the spring retainer 134. The forward-facing wall 126*a* of the hammer groove 126 presses against a rearward portion of the balls 130. This presses a forward portion of the balls 130 against the rearward-facing surface 124*b* of the cam shaft groove 124. The balls 130 are thereby trapped between the cam shaft 108 and the hammer 114, and couple the hammer 114 to the cam shaft 108. The cam shaft groove 124 need not be aligned with the hammer groove 126 to permit installation; rather, as the hammer 114 moves away from the cam shaft 108 when released, the hammer 114 rotates slightly over the balls 130 to align the hammer groove 126 with the cam shaft groove 124 in a neutral position.

The impact mechanism 104 further includes an axial stop for limiting axial displacement of the hammer 114 towards the rear end 107. The axial stop includes a first pair of stop members 140 on the spring retainer 134 facing the hammer 114 and a pair of corresponding second stop members 142 on the hammer 114 facing the spring retainer 134. In the illustrated embodiment, the stop members 140, 142 are bosses. In other embodiments (not shown), the stop members 140, 142 may have different shapes, and may be shaped differently from one another.

Figure 4A:
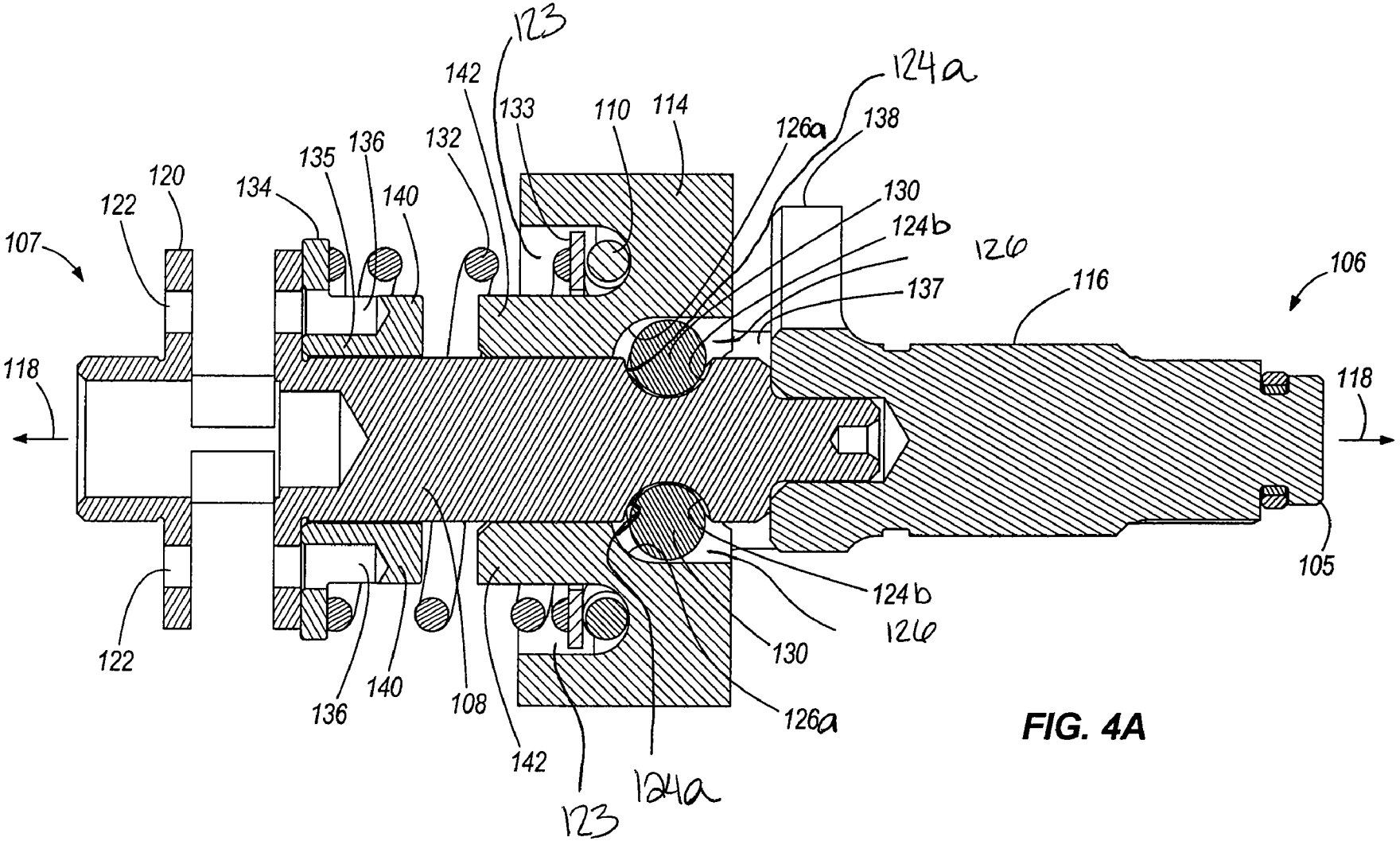
FIG. 4A is a cross-sectional view of the impact mechanism of FIG. 2 taken along line 4-4.
Figure 4B:
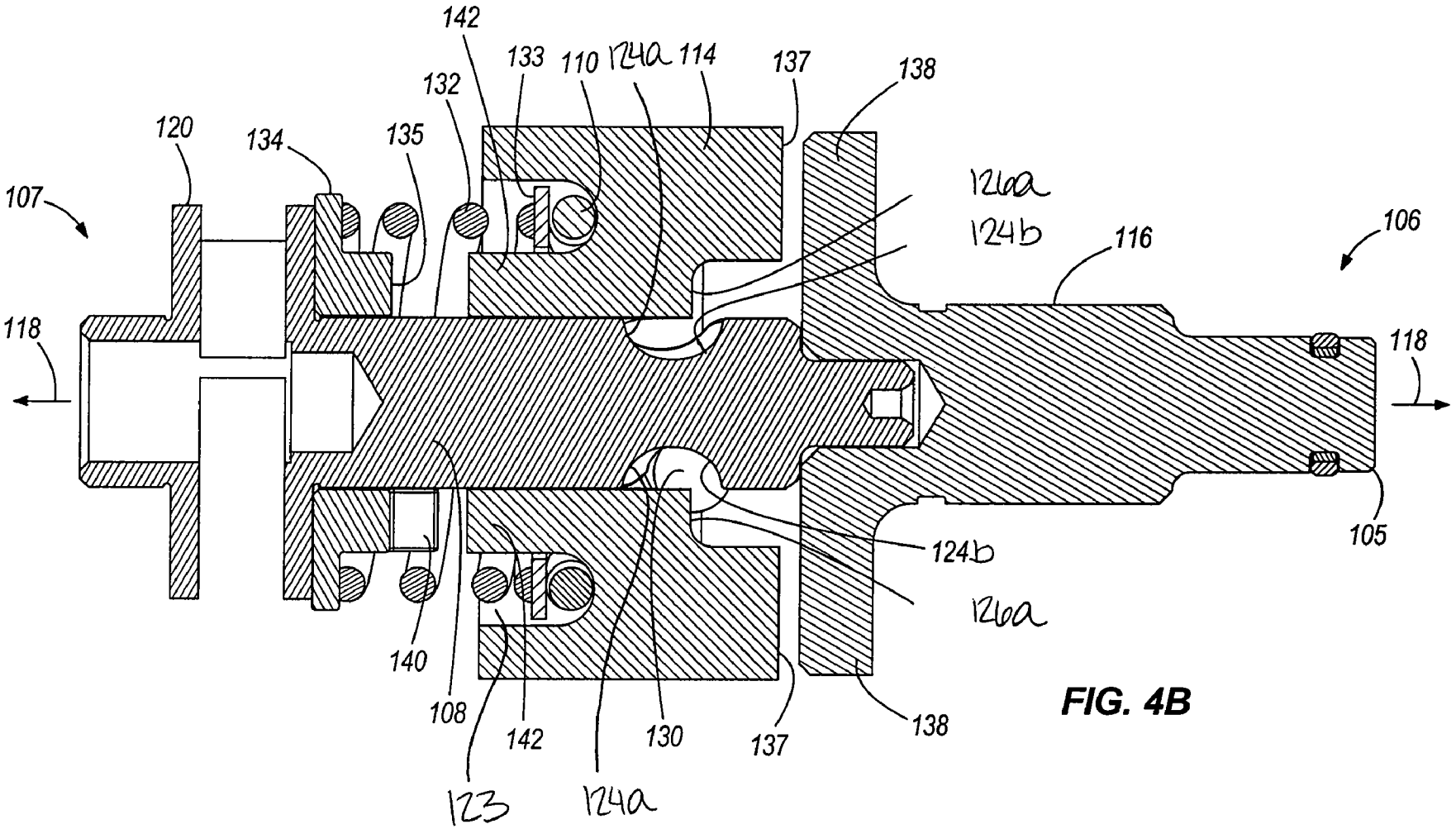
FIG. 4B is the cross-sectional view of the impact mechanism of FIG. 4A with the hammer rotated.

The first stop members 140 are aligned with the helical grooves 124 as well as the gear pin holes 122 on the planetary gear carrier 120. The second stop members 142 are likewise aligned with the helical grooves 126. As illustrated in FIG. 4A, the first stop members 140 are aligned with the second stop members 142 about the axis 118 when the impact mechanism 104 is not in use (i.e., when in the neutral position).

In operation, the motor 102 drives rotation of the cam shaft 108 about the longitudinal axis 118. During nut rundown, (i.e., when rotation of the anvil 116 is not significantly opposed), the hammer 114 rotates with the cam shaft 108 over the bearing 110. Rotational torque is transferred from the cam shaft 108 to the hammer 114 through the impact bearing 112. The hammer lugs 137 cooperate with the anvil lugs 138 to drive rotation of the anvil 116 and thereby the output spindle 105.

Figure 5:
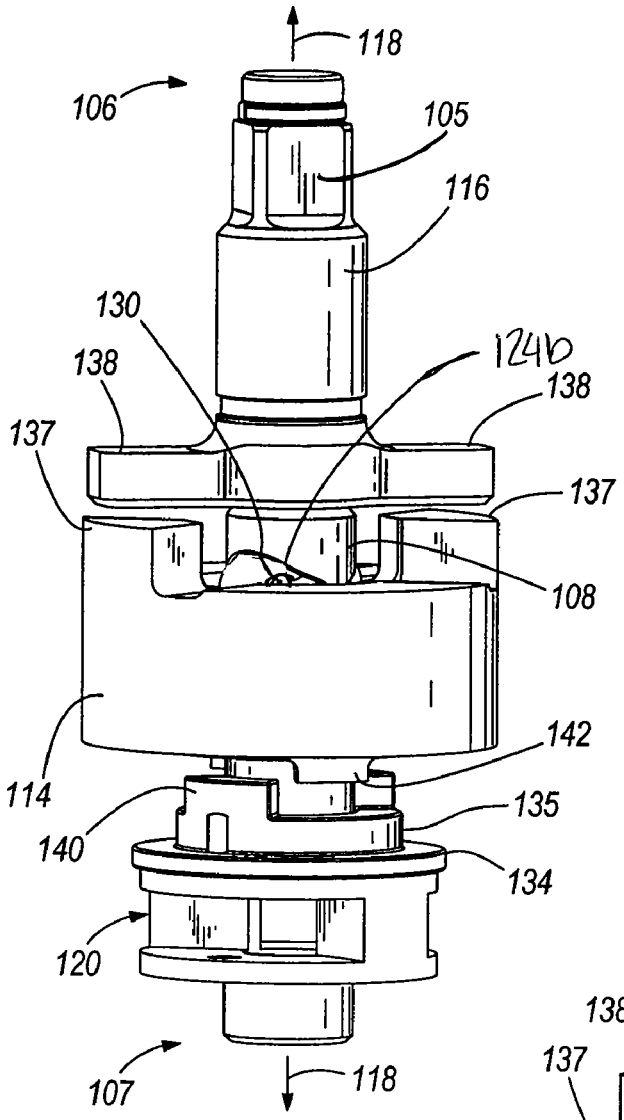
FIG. 5 is a side view of the impact mechanism of FIG. 4 during normal operation.

FIG. 5 shows the impact mechanism 104 as the nut tightens (nut not shown). When the nut tightens, the hammer 114 begins to rotate more slowly than the cam shaft 108. The rotation of the cam shaft 108 relative to the hammer 114 causes the balls 130 to roll along the grooves 124, 126 so that the hammer 114 pulls to the rear end 107 against the force of the spring member 132. The hammer 114 thus backs up the helical grooves 124 over the balls 130 away from the anvil 116. The balls 130 likewise travel along the grooves 124, 126 and remain trapped between the forward facing wall 126*a* and the rearward facing wall 124*b*. The hammer lugs 137 are thus lifted over the anvil lugs 138, which permits the hammer 114 to rotate unimpeded relative to the anvil 116 one-half of a revolution. As the hammer 114 rotates, the hammer 114 travels back down the helical grooves 124 towards the anvil 116 under the force of the spring member 132. The hammer 114 is thrust forward in time for engagement with the anvil lugs 138 at impact.

During normal operation, the hammer 114 moves along a first travel path that includes a helical rotation about the cam shaft 108. By helical rotation, it is meant that the first travel path both rotates about the cam shaft 108 and travels axially along the cam shaft 108. The axial stop does not interfere with axial travel of the hammer 114 while on the first travel path. This is because as the hammer 114 rotates relative to the spring retainer 134, the second stop members 142 become non-aligned with or circumferentially displaced from the first stop members 140. This non-alignment allows the hammer 114 to move towards the spring retainer 134 without the second stop members 142 encountering the first stop members 140.

Figure 6:
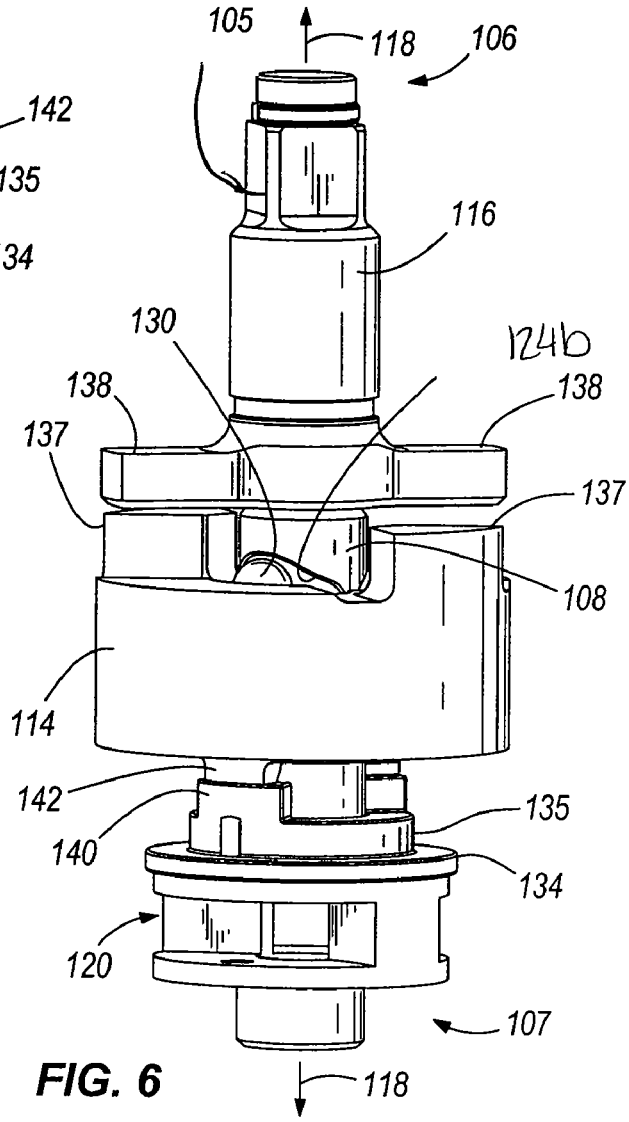
FIG. 6 is a side view of the impact mechanism of FIG. 4 when dropped on a rear end.

FIG. 6 illustrates the impact mechanism 104 if the impact tool 100 were dropped or struck on an end and in particular the rear end 107. The blow to the cam shaft 108 causes the hammer 114 to move against the force of the spring member 132 toward the spring retainer 134 along a second travel path that includes axial travel, but does not rotate. As the hammer groove 126 slides past the cam shaft groove 124, the cam shaft groove 124 is partially exposed and clearance between the rearward facing wall 124*b* of the cam shaft groove 124 and the forward facing wall 126*a* of the hammer groove 126 approaches the diameter of the balls 130. This approximates the configuration of the impact mechanism 104 during assembly when the hammer 114 is slid rearwardly to expose the cam shaft grooves 124 for insertion of the balls 130. Because the hammer 114 is not rotating, however, the second stop members 142 and the first stop members 140 remain aligned with one another as they are aligned with one another in the neutral position. As the hammer 114 approaches the spring retainer 134, the second stop members 142 encounter the first stop members 140, inhibiting further travel of the hammer 114 in an axial direction to the rear end 107. In particular, the hammer 114 is inhibited from moving rearwardly a sufficient distance as would permit the balls 130 to escape the exposed cam shaft groove 124.

The axial stop thus inhibits axial travel of the hammer 114 towards the rear end 107 when the hammer 114 is not rotating (i.e when the hammer 114 is in a neutral position aligned with cam shaft 134). This feature prevents the balls 130 from escaping the grooves 124, 126 if the impact tool 100 is dropped or struck on an end. The axial stop does not, however, inhibit axial travel when the hammer 114 is rotating (i.e., during normal operating conditions). Furthermore, the axial stop does not inhibit axial travel of the hammer 114 when the hammer is intentionally rotated relative to the cam shaft 108 as during assembly. This feature permits the hammer groove 126 to be machined with an open end, thus reducing the complexity of machining and providing for a simpler assembly process, while preventing the balls 130 from escaping the grooves 124, 126 through accident or mis-use of the impact tool.

In the illustrated embodiment, two first stop members 140 and two second stop members 142 are provided opposite one another. In other embodiments, more or fewer stop members are provided. The height of the stop members 140, 142 can be selected to determine the distance of non-rotational axial travel permitted. In the illustrated embodiment, the stop members 140, 142 have the same height. In other embodiments (not shown), the height of the stop members 140 is different from the height of the stop members 142.

In the illustrated embodiment, the first stop members 140 are provided on the spring retainer 134, which is separate from the cam shaft 108. In other embodiments (not shown), the spring retainer 134 and the first stop members 140 are provided directly on the cam shaft 108.

Thus, the invention provides, among other things, an axial stop for an impact mechanism for preventing the hammer from de-coupling from the cam shaft. Various features and advantages of the invention are set forth in the following claims.

What is claimed is:

1. An impact tool comprising:

a motor;

a shaft driven for rotation about an axis by the motor, the shaft having a first helical groove;

a hammer having a second helical groove;

a ball received in the first and second helical grooves, wherein the ball rotationally couples the hammer to the shaft and permits axial travel of the hammer relative to the shaft;

an anvil coupled to the hammer; and an axial stop, wherein the hammer is capable of moving along a first travel path and a second travel path different from the first travel path, wherein the hammer avoids abutment with the axial stop in the first travel oath to achieve a first axial displacement, and wherein the hammer abuts the axial stop in the second travel oath to limit axial displacement to a second axial displacement, less than the first axial displacement.

2. The impact tool of claim 1, wherein the first travel path rotates about the shaft and the second travel path is substantially non-rotational.

3. The impact tool of claim 1, wherein the axial stop includes first and second stop members, the first and second stop members having a first relative position to abut and limit axial travel of the hammer and a second relative position in which the first and second stop member do not abut during axial travel of the hammer.

4. The impact tool of claim 3, wherein in the first relative position the first and second stop members are aligned with one another about the axis and in the second relative position the first and second stop members are displaced from one another about the axis.

5. The impact tool of claim 1, wherein the second helical groove has an open end, wherein the axial stop inhibits the ball from escaping the open end.

6. The impact tool of claim 1, wherein the axial stop includes a first stop member coupled to the shaft and a cooperating second stop member coupled to the hammer.

7. The impact tool of claim 6, wherein the first and second stop members are bosses.

8. The impact tool of claim 6, further comprising a retainer disposed about the shaft, wherein the first stop member is formed on the retainer.

9. The impact tool of claim 6, wherein the first stop member is aligned with the first helical groove and the second stop member is aligned with the second helical groove.

10. An impact mechanism for an impact tool, the impact mechanism comprising:

a shaft having a first helical groove;

a hammer having a second helical groove;

a ball received in the first and second helical grooves, wherein the ball rotationally couples the hammer to the shaft and permits axial travel of the hammer relative to the shaft;

an anvil coupled to the hammer; and an axial stop, wherein the hammer is capable of moving along a first travel path in which the hammer travels a first axial distance and a second travel path in which the axial stop limits axial travel of the hammer to less than the first axial distance to retain the ball within the first and second helical grooves when the hammer travels alone the second travel path.

11. The impact mechanism of claim 10, wherein the first travel path rotates about the shaft and the second travel path is substantially non-rotational.

12. The impact mechanism of claim 10, wherein the axial stop includes first and second stop members, the first and second stop members having a first relative position to abut and thereby limit axial travel of the hammer to a first distance and a second relative position to permit axial travel of the hammer over a second distance, greater than the first distance.

13. The impact mechanism of claim 12, wherein in the first relative position the first and second stop members are aligned with one another about the axis and in the second relative position the first and second stop members are displaced from one another about the axis.

14. The impact mechanism of claim 10, wherein the axial stop includes a first stop member coupled to the shaft and a cooperating second stop member coupled to the hammer.

15. The impact mechanism of claim 14, wherein the first stop member is aligned with the first helical groove and the second stop member is aligned with the second helical groove.

16. An impact tool comprising:

a motor;

a shaft rotatable about an axis in response to the motor, the shaft defining at least one groove;

a ball positioned at least partially within the at least one groove;

a spring member coupled to the shaft;

a hammer coupled to the shaft, the hammer defining at least one groove positioned to at least partially receive the ball, the hammer having at least one lug;

an anvil having at least one lug, such that the anvil lug is selectively coupled to the hammer lug for rotation with the hammer about the axis, wherein the spring is positioned to selectively bias the hammer into engagement with the anvil; and at least one stop member, wherein the ball moves radially and axially along at least one of the shaft groove and the hammer groove as the hammer travels along a first helical path with respect to the anvil, and wherein the ball remains substantially radially fixed with respect to at least one of the shaft groove and the hammer groove as the hammer travels along a second radial path with respect to the anvil.

17. The impact tool of claim 16, wherein the shaft groove and the hammer groove are helical such that the ball moves along the shaft groove and the hammer groove as the hammer travels along the first path.

18. The impact tool of claim 16, wherein the hammer travels along the first path during normal operation and travels along the second path when the impact tool is struck on an end.

19. The impact tool of claim 16, further comprising a spring retainer received on the shaft and wherein the at least one stop member includes a first stop member coupled to the hammer and a second stop member coupled to the shaft, such that the first stop member abuts against the second stop member to limit axial movement along the second path, to thereby retain the ball within the shaft groove and the hammer groove.

20. The impact tool of claim 16, further comprising a first stop member coupled to the shaft and a second stop member coupled to the hammer, the first and second stop members abut at an end of the second path to inhibit further axial movement beyond the end of the second path.

* * * * *

UNITED STATES PATENT AND TRADEMARK OFFICE

CERTIFICATE OF CORRECTION

PATENT NO. : 7,673,702 B2
APPLICATION NO. : 11/836279
DATED : March 9, 2010
INVENTOR(S) : Joshua Odell Johnson, Ryan Scott Amend and Warren Andrew Seith It is certified that error appears in the above-identified patent and that said Letters Patent is hereby corrected as shown below:

| | |
|---|---|
| Column 5, line 43: | Replace the word "oath" with the word <u>path</u> |
| Column 5, line 46: | Replace the word "oath" with the word <u>path</u> |
| Column 6, line 24: | Replace the word "alone" with the word <u>along</u> |

Signed and Sealed this

Fourth Day of May, 2010

David J. Kappos

David J. Kappos
*Director of the United States Patent and Trademark Office*